US005186187A

United States Patent [19]

Roberts

[11] Patent Number: 5,186,187

[45] Date of Patent: Feb. 16, 1993

[54] HAIR ROLLER

[76] Inventor: Kenneth B. Roberts, 3832 E. Loyola Dr., Kenner, La. 70065

[21] Appl. No.: 603,235

[22] Filed: Oct. 25, 1990

Related U.S. Application Data

[63] Continuation-in-part of Ser. No. 396,060, Aug. 21, 1989, Pat. No. 5,000,200.

[51] Int. Cl.[5] ..... A45D 2/14

[52] U.S. Cl. ..... 132/245; 132/265; 132/250

[58] Field of Search ..... 132/223, 226, 222, 245, 132/246, 247, 248, 253, 237, 262, 268, 265

[56] References Cited

U.S. PATENT DOCUMENTS

| | | | |
|---|---|---|---|
| 2,166,386 | 7/1939 | Auster | 132/246 |
| 2,411,336 | 11/1946 | Reiter | 132/248 |
| 2,892,460 | 6/1959 | Leclabart | 132/265 |
| 2,936,766 | 5/1960 | Beverly | 132/247 |
| 2,960,989 | 11/1960 | Magee | 132/262 |
| 3,444,864 | 5/1969 | Glushakow | 132/223 |
| 3,556,114 | 1/1971 | Simon | 132/262 |
| 3,583,409 | 6/1971 | Rios | 132/265 |
| 3,590,829 | 7/1971 | Parisi | 132/226 |
| 3,623,491 | 11/1971 | Garrett | 132/245 |
| 3,683,940 | 8/1972 | Debue | 132/262 |
| 4,022,225 | 5/1977 | Kauffman | 132/223 |
| 4,022,226 | 5/1977 | Muenstermann | 132/245 |
| 4,316,476 | 2/1982 | Merges | 132/253 |
| 4,456,020 | 6/1984 | van Deursen | 132/265 |

FOREIGN PATENT DOCUMENTS

| | | | |
|---|---|---|---|
| 1003318 | 3/1952 | France | 132/248 |

*Primary Examiner*—John J. Wilson
*Assistant Examiner*—Frank A. LaViola
*Attorney, Agent, or Firm*—Keaty & Keaty

[57] ABSTRACT

The invention relates to hair rollers and provides for the use of a cylindrical tube rolled from a rectangular perforated sheet of flexible material, the sheet having an outer edge which overlaps a portion of the tube. The tube has a pair of opposing transverse edges, each of which is engaged within a spiral groove formed in opposing caps. The caps are rotationally mounted on an elongated shaft, such that rotation of the disks causes advancement of the transverse edges within the sprial groove, changing the diameter of the outer tube, as desired. An indicia on the outer surface of one or two caps allows to select the diameter of the tube when rotating the caps. The shaft has slotted projections on opposing ends with one or both of which an elongated resilient band is engaged.

15 Claims, 1 Drawing Sheet

HAIR ROLLER

REFERENCE TO RELATED APPLICATION

This application is a continuation-in-part of my copending application Ser. No. 396,060 filed Aug. 21, 1989 now U.S. Pat. No. 5,000,200 entitled "Hair Roller", the disclosure of which is incorporated by reference herein.

BACKGROUND OF THE INVENTION

The present invention relates to personal grooming, and in particular to hair rollers which are used for curling of human hair.

It has been a long practice in hair dressing to curl a person's hair in order to transform straight hair to curly or wavy hair, thus satisfying a specific need or wish of a person to change the appearance of the hair for various reasons. Through the years, various type of rollers have been developed and used by hairdressers, as well as the general public. Traditionally, hair rollers are formed as a cylindrical-shaped tube on which the hair is rolled and after that secured on the roller to remain wrapped thereon for a certain period of time in order to allow the hair to set in its curled up fashion.

Since human hair differs from person to person, and the requirements of a particular person call for various sizes of curl, the companies who manufacture such devices offer various size rollers, that is rollers having various diameters, so as to effect the size of the curl/or wave which can be produced as a result of using the particular type and size of roller. As is often the case, a person needs to buy a number of different sets of rollers, each set having a different diameter tube so as to create various size curls. It becomes especially space consuming, when such sets have to be stored at home. In addition, the purchase of various size rollers involves expenditure of funds to purchase different sets of rollers.

The present invention contemplates provision of a universal hair roller, which can be easily manipulated to change the size of the tube on which the hair is rolled, thus allowing the person an alternative to purchasing and utilizing various sets of rollers.

SUMMARY OF THE INVENTION

The present invention achieves its objects and overcomes shortcomings of the prior art in a simple and straight forward manner. The hair roller of the present invention is formed with a pair of spaced-apart caps, each attached to opposite ends of an elongated shaft. Each of the caps is formed as a circular disk, with an inner surface of each disk having a continuous spiral groove extending from an outer circumference of the disk to approximately the center of the disk. A central opening in the disk frictionally engages one end of the shaft. Each disk is adapted for rotational engagement on the respective end of the shaft.

An elongated tube is formed from a rectangular sheet of flexible material, such as plastic, and rolled to form a cylindrical tube. The plastic sheet has an interior surface and an exterior surface. The exterior surface is made with a plurality of tiny outwardly extending projections so as to make the exterior surface "rough" to facilitate holding of hair on the roller. A plurality of random perforations or apertures are formed through the plastic sheet to permit better access of air to the hair and thus expedite drying of hair rolled on the roller. An outer elongated edge of the rectangular sheet overlaps at least a portion of the tube. The length of the outer edge approximates the length of the elongated shaft which carries the disks. The cylindrical tube has opposing transverse edges which are engaged within the spiral grooves of the opposing disks.

Rotation of the disks causes advancement of the transverse edges within the spiral groove, rolling the tube into a smaller diameter, thus changing the outer circumference of the cylindrical tube, as desired. Rotation of the disks in the opposite direction causes retraction of the transverse edges of the tube within the spiral groove, thus increasing the outer diameter of the tube.

To simplify selection of diameters, one of the caps is provided with an indicia dividing the circumference of the disk exterior surface into a plurality of equal segments which can be optionally numbered, for example, from 0 to 4, the smallest number indicating the smallest diameter of the tube, and the largest number indicating the greatest diameter of the tube.

When making up the hair roller, opposite ends of the longitudinal edge of the tube are engaged within outer ends of the spiral groove, and continuous rotation of the disks causes advancement on the transverse edges within the grooves. The reading on the adjustment cap, or disk allows an easy selection of the amount of rotation to apply to the cap in order to achieve a desired diameter hair roller. The shaft is provided with slotted projections on opposite ends thereof for securing of a flexible resilient band which facilitates retaining of the roller and the lock of hair rolled on the roller. In another embodiment a band securing knob is engaged with an outwardly extending one end of the shaft.

It is therefore an object of the present invention to provide an improved hair roller with means to change the outer diameter of the tube on which the hair is to be rolled.

It is a further object of the present invention to provide a means for indicating the diameter of the hair roller associated with the improved hair roller.

It is still a further object of the present invention to provide a hair roller comprising a means to prevent slipping of hair while rolling the hair.

These and other objects of the present invention will be apparent to those skilled in the art from the following description of the invention.

BRIEF DESCRIPTION OF THE DRAWINGS

A reference will now be made to the drawings, wherein like numerals designate like parts, and wherein.

DETAILED DESCRIPTION OF THE PREFERRED EMBODIMENT

Figure 1:
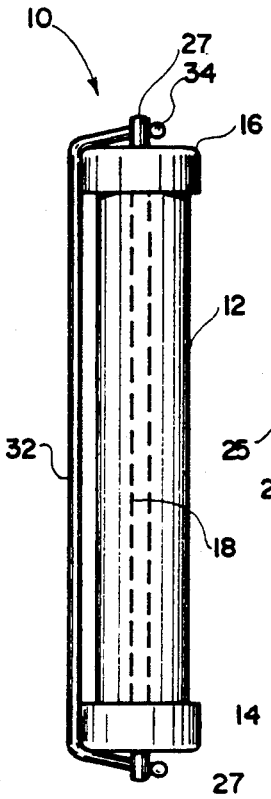
FIG. 1 is a perspective view of the hair roller in accordance with the present invention.
Figure 2:
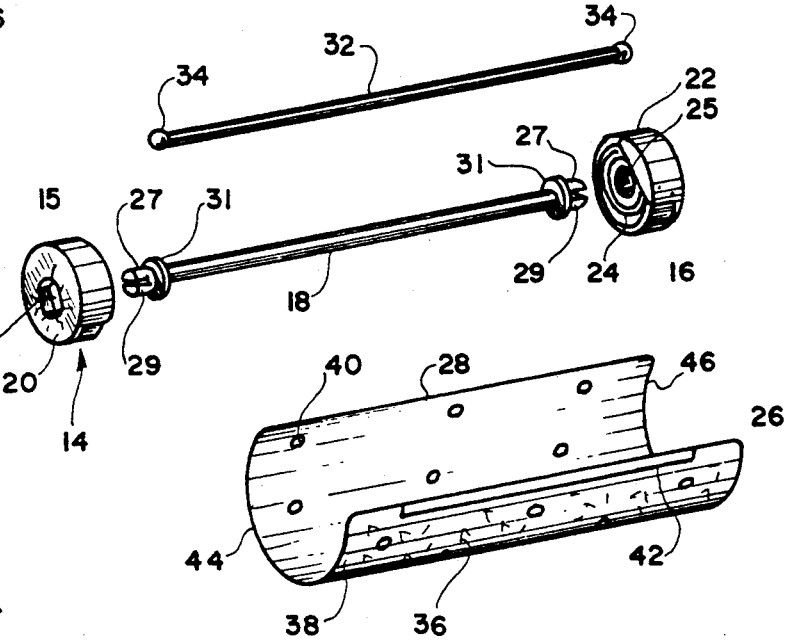
FIG. 2 is an exploded view of the hair roller in accordance with the present invention.

Referring to the drawings in detail, and in particular to FIGS. 1 and 2, the hair roller in accordance with the present invention is designated by numeral 10. Hair roller 10 comprises a generally cylindrical sleeve 12, a first cap 14, a second cap 16, both caps detachably secured to the tube 12. The caps 14 and 16 are rotationally secured on opposite ends of an interior shaft 18. Each of the caps 14 or 16 is formed circular in shape, with an exterior side 20 and an interior side 22. Formed in the interior side 22 and extending a distance into the thickness of the cap 14 or 16 is a spiral groove 24 which begins on the outer circumference of the cap 14 or 16 and extends in a spiral fashion, terminating adjacent a center of each cap.

As will be appreciated, the noncontinuous circles which are formed by the groove 24 gradually reduce in diameter from the greatest diameter occupied by the groove most adjacent to the outer circumference of the cap 14 or 16, to the smallest diameter adjacent the center of the cap. Cap 14 (or both caps 14 and 16) is provided with an indicia 15 on the outer surface 20 dividing the circumference into a plurality of segments in order to assist a user in the amount of rotation to be applied to the cap(s) in order to achieve a certain diameter of the tube 12.

Optionally, numbers, for example, from 0 to 4 can be inscribed on the surface(s) 20 to further facilitate easy selection of the tube 12 diameter size, with the smallest number designating the smallest diameter and with the largest number designating the largest possible diameter which can be achieved for the tube 12.

The central shaft 18 extends between the two caps, whereby the caps are secured to opposite ends of the shaft 18 at the centers of the caps. A central opening 25 is formed in each of the caps to receive the end of the shaft 18 therein. Each opening 25 is sized and shaped to frictionally engage in a tight fit a non-circular projection 27 of the shaft 18 therethrough. Projections 27 are provided with slots 29 which terminate before reaching enlarged diameter annular flanges 31 formed on opposite ends of the shaft 18. The flanges 31 act as a stop means for the caps 14 and 16 and prevent disengagement of the caps from the shaft 18.

A resilient flexible band 32 is engaged at one of its ends within a slot 31 of either cap 14 or 16. The second end of the band 32 is left non-engaged until the hair lock is rolled on the tube 12. Then the second end of the band 32 is stretched and engaged, under tension within a slot 29 of the second projection 27, thus securing the hair lock and the roller 10 together.

The band 32 has thickened ends 34, the diameter of which, even in a compressed state, is at least slightly greater than the size of the slot 29. In this manner, the band remains engaged within the slots 29, once it is secured therein. The caps 14 and 16 are adapted for free rotational movement about the shaft 18 and can be completely disengaged from the shaft 18, if so desired.

The sleeve or tube 12 is formed from a substantially rectangular piece of flexible resilient material, such as plastic, and is thermo-processed to retain its generally cylindrical shape. A first outer edge 26 of the sleeve 12 overlaps, to a certain degree, the portion of the tube 12 when shaped into a cylinder. The inner longitudinal edge 28 of the sleeve 12 extends through the length of the tube 12 but on the interior side thereof. The plastic sheet is formed with a plurality of tiny projections 36 on its outer surface 38 which give the surface 38 a "rough" feeling. Use of the "rough" instead of a "smooth" surface assists in retaining the hair on the tube 12.

A plurality of holes 40 are formed in the tube 12, so as to expedite drying of hair rolled on the roller 10 by improving the access of air to the hair.

In order to prevent bending of the edge 26 during rotation of the caps 14 and 16, a stiffening piece 42 is secured along at least a part of the edge 26. The outermost ends of the edge 26 are left of the original thickness, so as not to interfere with movement of transverse edges 44 and 46 of the tube 12 within the grooves 24.

During assembling, the transverse edges 44 and 46 are forced into the grooves 24 of the opposite caps 14 and 16 and are engaged therein. By rotating the caps 14 and 16 the tube 12 is forced into engagement with the spiral groove 24, moving the inner edge 28 towards the center of the caps 14 and 16. In this manner the outermost edge 26, when the roller unit is assembled, appears adjacent an outermost end of the spiral groove 24. Continuous rotation of the caps 14 and 16 causes the edge 28 further into the groove 24, until it reaches its center, pulling the entire sheet which forms the sleeve 12, and forcing the edge 26 further into the groove 24. In this manner, the tube 12 eventually presents a smaller outside diameter on its outer surface, until it reaches a minimum diameter when the transverse length of the sleeve 12 extends itself through the groove 24. As will be appreciated, the groove 24 in its longitudinal dimension is longer than the transverse length of the sheet from which the sleeve 12 is formed. This allows the tube 12 to be formed of the smallest necessary diameter currently acceptable for the rolling of hair or alternatively, it can assume its less tightly rolled diameter, wherein the edge 28 is closer to the outermost edge of the groove 24.

When the necessary diameter tube 12 is reached, through rotation of the caps 14 and 16, the hair roller 10 is used in a conventional manner, that is the hair is rolled on the outer circumference of the tube 12 and is secured by the rubber band 32.

Figure 3:
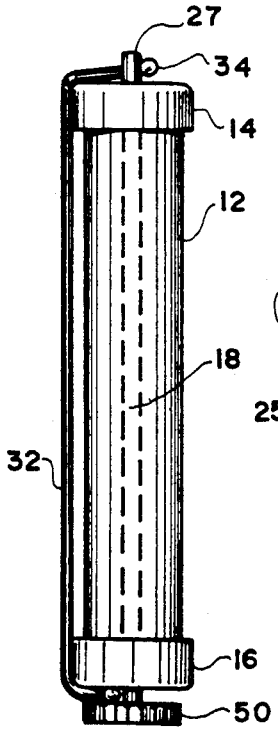
FIG. 3 is a perspective view of another embodiment of the hair roller in accordance with the present invention.
Figure 4:
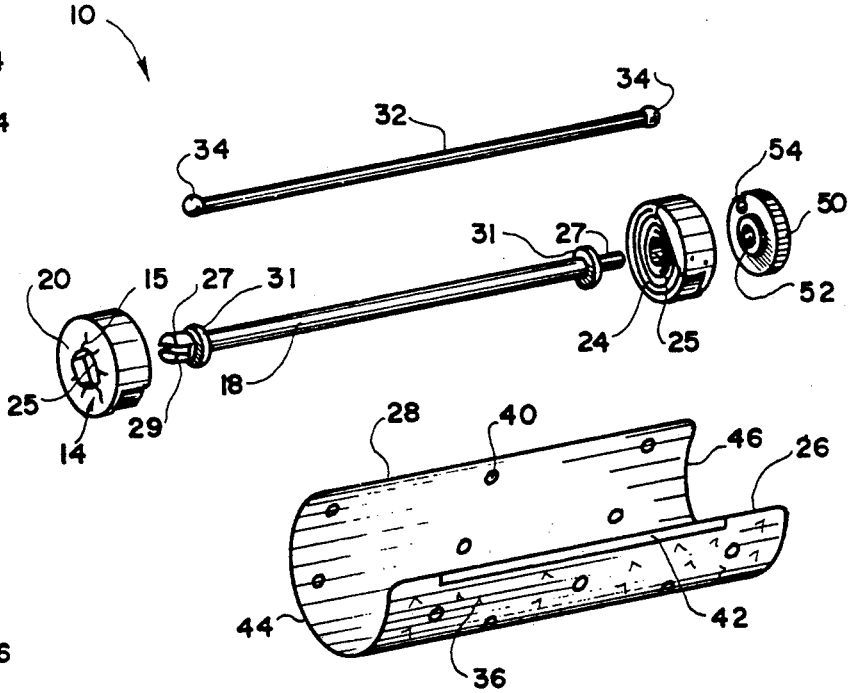
FIG. 4 is an exploded view of the embodiment shown in FIG. 3.

Referring now to FIGS. 3 and 4, another embodiment of the hair roller is illustrated.

The roller 10 is seen to further comprise a resilient band securing knob 50 which is frictionally engaged on the outwardly extending portion 27 of the shaft 18. In this embodiment the portion 27 is made long enough to accommodate the thickness of the knob 50, and the central opening 52 fits over the portion 27.

A groove 54 is formed int eh disk-shaped knob 50 and extends from the outer circumference thereof inwardly, not reaching the opening 52. The groove 54 receives one end of the flexible, resilient securing band 32. The second end of the band 32 is engaged in the slot 29 of the projection 27 adjacent the cap 14. The hair is rolled on the roller 10 while the knob 50 is disengaged. After the hair is rolled, the knob 50 is manipulated, pulling and stretching the band 32 until the knob 50 is adjacent the cap 16. The knob is then snapped on the projection 27 to secure the roller 10 and the user's head.

The operation of the tube 12 is similar in both the first and second embodiments.

The hair roller unit of the present invention is formed of lightweight material such as lightweight plastic, requirements being that the sheet from which the tube 12 is made should be flexible and manageable and retain its outer cylindrical form, that the caps 14 and 16 be made of sufficiently strong plastic to allow cutting of the grooves 24 through substantially entire width thereof, and that the shaft 18 be strong enough to withstand possible bending forces which may be applied to it during rotation of the caps 14 and 16 engaged on the shaft ends.

Alternatively, the shaft 18 can be formed from aluminum or other similar material if desired.

The tube 12 can be made of various colors and textures, while retaining its basic physical shape.

It is preferable that the grooves 24 do no extend to the outside surface 20 of the caps 14 and 16, so as to prevent disengagement and shifting of the tube 12, when secured within the groove 24.

Many changes and modifications can be made within the design of the hair roller in accordance with the present invention without departing from the spirit thereof. I therefore pray that my rights to the present invention be limited only by the scope of the appended claims.

I claim:

1. A hair roller, comprising:

a pair of spaced-apart cap means rotationally mounted on opposite ends of an elongated shaft means, said cap means comprising a substantially circular disk having an outer surface and an inner surface, said disk being provided with a central opening for receiving one end of the shaft means in frictional engagement therein;

a substantially cylindrical outer tube means extending between said cap means, said tube means comprising a substantially rectangular flexible sheet rolled into a cylindrical tube, the sheet having an outer elongated edge overlapping at least a portion of the tube, and a first and a second transverse edges, said outer elongated edge being provided with a stiffening piece to prevent bending of the outer edges during rotation of the caps;

a means for changing exterior diameter of the tube means carried by said cap means, said cap means being provided with means for indicating a diameter of the tube means, wherein said means for changing exterior of the tube means comprises a continuous spiral groove formed in the inner surface of each disk and extending from an outer circumference of the disk towards approximately a center of each disk, said groove being adapted to receive a transverse edge of said rectangular sheet in frictional engagement therein, and whereby rotation of said disks causes continuous advancement of the sheet along the groove.

2. The device of claim 1, wherein said groove extends from the disk inner surface a distance towards the disk's outer surface.

3. A hair roller, comprising:

a pair of spaced-apart cap means rotationally mounted on opposite ends of an elongated shaft means, wherein said shaft means is provided with co-axial slotted projections on opposite ends thereof and an enlarged diameter flange formed inwardly from said projections on said shaft means opposite ends, said flanges limiting outward movement of the cap means along the shaft means;

a substantially cylindrical outer tube means extending between said cap means; and a means for changing exterior diameter of the tube means carried by said cap means, said cap means being provided with means for indicating a diameter of the tube means.

4. The device of claim 3, further comprising an elongated flexible resilient band engaged by one of its ends within a slot of one of the projections, a second end being engageable within a slot of an opposing projection.

5. A hair roller, comprising:

a pair of spaced-apart cap means rotationally mounted on opposite ends of an elongated shaft means;

a substantially cylindrical outer tube means extending between said cap means; and a means for changing the diameter of the tube means carried by said cap means, said cap means being provided with means for indicating the diameter of the tube means, wherein said indicating means comprise an indicia imprinted on an outer surface of at least one of said caps means, said indicia dividing a circumference of the cap means into a plurality of segments which correspond to a size of an outer diameter of the tube means.

6. A hair roller, comprising:

a pair of spaced-apart cap means rotationally mounted on opposite ends of an elongated shaft means, said shaft means being provided with co-axial projections on opposite ends thereof, one of said projections having a slot adapted to receive one end of a flexible resilient securing band;

a substantially cylindrical outer tube means extending between said cap means; and a means for changing exterior diameter of the tube means carried by said cap means, said cap means being provided with means for indicating a diameter of the tube means.

7. The device of claim 6, wherein said shaft is formed with enlarged diameter flanges inwardly from said projections, said flanges limiting movement of the caps outwardly along said shaft.

8. The device of claim 6, further comprising a knob for securing a second end of the resilient band, said knob being engageable with a second of said projections.

9. A hair roller comprising:

a pair of spaced-apart cap means rotationally mounted adjacent opposite ends of an elongated shaft means, each of said cap means comprising a substantially circular disk having an outer surface and an inner surface, each disk being provided with a central opening for receiving one end of the shaft means in frictional engagement therein and with a spiral groove extending from an outer circumference of the disk inner surface to approximately a center of each disk, each of said shaft opposite ends being provided with a projection; and a substantially cylindrical outer tube means extending between said cap means, said tube means comprising a substantially rectangular flexible perforated sheet rolled into a cylindrical tube, the sheet having an outer elongated edge overlapping at least a portion of the tube, and a first and a second transverse edges, said transverse edges being received in frictional engagement within the spiral grooves of the opposing disks, and wherein rotation of the disks causes advancement of the transverse edges of the sheet within the spiral groove, thereby changing diameter of the outer tube, at least one of said disks being provided with a means for indicating a diameter of the tube means comprising an indicia imprinted on an outer surface of said disk, the indicia dividing a circumference of the disk into a plurality of segments.

10. The device of claim 9, wherein said groove extends from the disk inner surface a distance towards its outer surface.

11. The device of claim 10, wherein one of said projections is formed with a slot to receive one end of a flexible resilient band therein.

12. The device of claim 11, further comprising a disk-shaped knob engageable with a second of said shaft projections, said knob having a groove to secure a second end of the resilient end.

13. The device of claim 10, wherein said sheet is formed with a plurality of holes to facilitate air circulation to the hair.

14. The device of claim 10, wherein said sheet has an outer surface which is formed with a plurality of minute projections to form a non-smooth tube outer surface.

15. The device of claim 9, wherein said shaft is formed with a pair of enlarged diameter flanges positioned inwardly from said projections, said flanges preventing disengagement of the disks from the shaft means.

* * * * *